US010767309B2

(12) United States Patent
Lindblom

(10) Patent No.: US 10,767,309 B2
(45) Date of Patent: Sep. 8, 2020

(54) REFINER SEGMENT IN A FIBER REFINER

(71) Applicant: VALMET AB, Sundsvall (SE)

(72) Inventor: Thommy Lindblom, Hägersten (SE)

(73) Assignee: VALMET AB, Sundsvall (SE)

( * ) Notice: Subject to any disclaimer, the term of this patent is extended or adjusted under 35 U.S.C. 154(b) by 90 days.

(21) Appl. No.: 16/119,025

(22) Filed: Aug. 31, 2018

(65) Prior Publication Data

US 2019/0071821 A1 Mar. 7, 2019

(30) Foreign Application Priority Data

Sep. 1, 2017 (SE) ..... 1751058

(51) Int. Cl.
*D21D 1/30* (2006.01)

(52) U.S. Cl.
CPC ..... *D21D 1/306* (2013.01)

(58) Field of Classification Search
USPC ..... 162/261
See application file for complete search history.

(56) References Cited

U.S. PATENT DOCUMENTS 4,953,796 A 9/1990 Virving
5,373,995 A 12/1994 Johannson
2012/0018549 A1 1/2012 Gingras

FOREIGN PATENT DOCUMENTS

WO WO 98/33594 A1 8/1998

OTHER PUBLICATIONS

European Extended Search Report, Application No. 18446502.9, dated Oct. 16, 2018, 8 pages.

*Primary Examiner* — Mark Halpern
(74) *Attorney, Agent, or Firm* — Foley & Lardner LLP

(57) ABSTRACT

A refiner segment (4) for a refiner (1) intended for refining fibrous material (7) has a refining surface and is arrangeable to form a part of a refining surface of a refiner element (2; 3) in the refiner (1). The refiner segment (4) is provided with a pattern of bars (10) and intermediate grooves (11) extending along the refiner segment (4) in a substantially radial direction, and dams (12) extending between the bars (10) and protruding above the surface of the grooves (11). Steam channels (13) are arranged through the bars (10) adjacent to an intersection between a bar (10) and a dam (12), radially outside of a respective dam (12) with respect to an inner edge (41) of the refiner segment (4), and at a trailing end of the respective dam (12) with respect to a first circumferential direction corresponding to an intended travelling direction (20) of the refiner segment (4), where the steam channels (13) are configured to allow steam (8) flowing towards the inner edge (41) of the refiner segment (4) to pass through the steam channels (13) in a direction having a component directed opposite to the first circumferential direction (20).

7 Claims, 7 Drawing Sheets

I < O

I ≥ O

REFINER SEGMENT IN A FIBER REFINER

TECHNICAL FIELD

The present invention generally relates to refining of fibrous material in a fiber refiner, and more particularly to feed variations during the refining process.

BACKGROUND

Refiners used for refining fibrous material, such as wood chips, into pulp typically comprise one or more refiner elements positioned oppositely and rotating relative to each other. One or both of the refiner elements can be rotatable. A fixed i.e. stationary refiner element is called the stator and the rotating or rotatable refiner element is called the rotor. In disc refiners, the refiner elements are disc-like and in cone refiners the refiner elements are conical. In addition to disc refiners and cone refiners, there are also so-called disc-cone refiners where the material to be defibrated is first refined by disc-like refiner elements and then further refined between conical refiner elements. Furthermore, there are also cylindrical refiners where both the stator and the rotor of the refiner are cylindrical refiner elements.

The refiner elements are positioned such that a refining space/gap is formed between the inner surfaces, i.e. the surfaces opposing one another, of the refiner segments. In disc refiners, which represent the most common refiner type, the material to be refined is usually fed through an opening in the middle of one of the refiner discs, usually the stator, to a central space between the discs. The material is then forced by the centrifugal force towards the circumference of the discs to emerge in the refining space/gap, where the refining/grinding of the fibrous material is carried out. The refined material is discharged from the refining space/gap, from the outer periphery of the refining surfaces of the refiner discs, to be fed onwards in the pulp manufacturing process.

The inner (refining) surfaces of the refiner elements are typically provided with one or more refiner segments, which are formed with a pattern of bars and intermediate grooves of different sizes and orientations, for improving the grinding action on the fibers. The refiner segments are typically positioned adjacently in such a way that each refiner segment forms part of a continuous refining surface. The pattern of bars and grooves may be divided into different zones located outside each other, e.g. a radially inner inlet zone where the fibrous material is fed into the refiner, and a radially outer refining zone where the refining of the material takes place. In the inlet zone there are usually fewer bars and grooves, and the pattern is coarser than in the refining zone. Normally, the bars and grooves of the refiner segments extend substantially radially with respect to the rotational center of the refiner elements.

When the fibrous material is refined in the refining space/gap between the refiner elements, some of the moisture in the material is turned into steam. The steam flow is usually very irregular, but some steam will flow towards the circumference of the refiner elements along with the material, and some of the steam will also flow "backwards" towards the center of the refiner elements. The steam flow will depend—among other things—on how the refiner segments are designed. The back-streaming steam will mainly flow in the grooves formed between the bars of the refiner segments towards the center of the refiner elements.

Usually, flow restrictions or dams are inserted in the grooves in the refiner segments in order to prevent unprocessed material to pass out through the refining gap. The dams guide the material to the space between opposite refiner bars, and thereby refining of the material can be promoted. However, the dams constitute an obstacle to the steam developed in the refining gap during the refining process. The steam is also forced upwards out of the grooves by the dams and disturbs the material flow through the refining gap.

This in turn leads to blockage on the refining surface, which may affect the stability of the refining gap, rendering the material flow through the gap non-uniform. Variations in feed within the refining gap causes a decrease in the production capacity of the refiner, non-uniformity of the quality of the refined material and an increase in the energy consumed for the refining. Therefore, there is a need for improving the design of the refiner segments in order to overcome the above mentioned disadvantages.

SUMMARY

It is an object to provide a refiner disc which reduces the feed variations during the refining process.

This and other objects are met by embodiments of the proposed technology.

According to a first aspect, there is provided a refiner segment for a refiner intended for refining fibrous material, where the refiner segment has a refining surface and is arrangeable to form a part of a refining surface of a refiner element in the refiner. The refiner segment has a radially inner edge and a radially outer edge and is provided with a pattern of bars and intermediate grooves extending along the refiner segment in a substantially radial direction with respect to the inner edge of the refiner segment, and dams extending between the bars and protruding above the surface of the grooves. The bars are provided with steam channels arranged through the bars, where each channel is located adjacent to an intersection between a bar and a dam, radially outside of a respective dam with respect to the inner edge of the refiner segment, and at a trailing end of the respective dam with respect to a first circumferential direction corresponding to an intended travelling direction of the refiner segment, where the steam channels are configured to allow steam flowing towards the inner edge of the refiner segment to pass through the steam channels in a direction having a component directed opposite to the first circumferential direction.

According to a second aspect, there is provided a refiner for refining fibrous material, comprising at least one refiner segment according to the above.

By introducing channels in the bars near the dams, thereby creating a passage for steam flowing towards the center of the refiner without forcing the steam into the refining gap, at least the following advantages can be achieved:

- Reducing feed conflicts in the refining gap which in turn leads to less feed disturbance, less vibrations, less micro-pulsation etc.
- Preventing the area just after the dams from becoming a "dead zone" with lower steam pressure and less movement of the material, which means that pitch build-up can be avoided.

Other advantages will be appreciated when reading the detailed description.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference designations are used for similar or corresponding elements.

Figure 2:
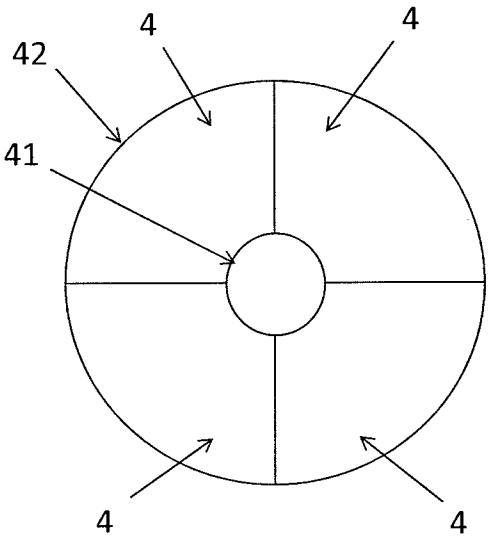
FIG. 2 is a schematic illustration of a refining surface comprising a plurality of refiner segments according to prior art technology.
Figure 1:
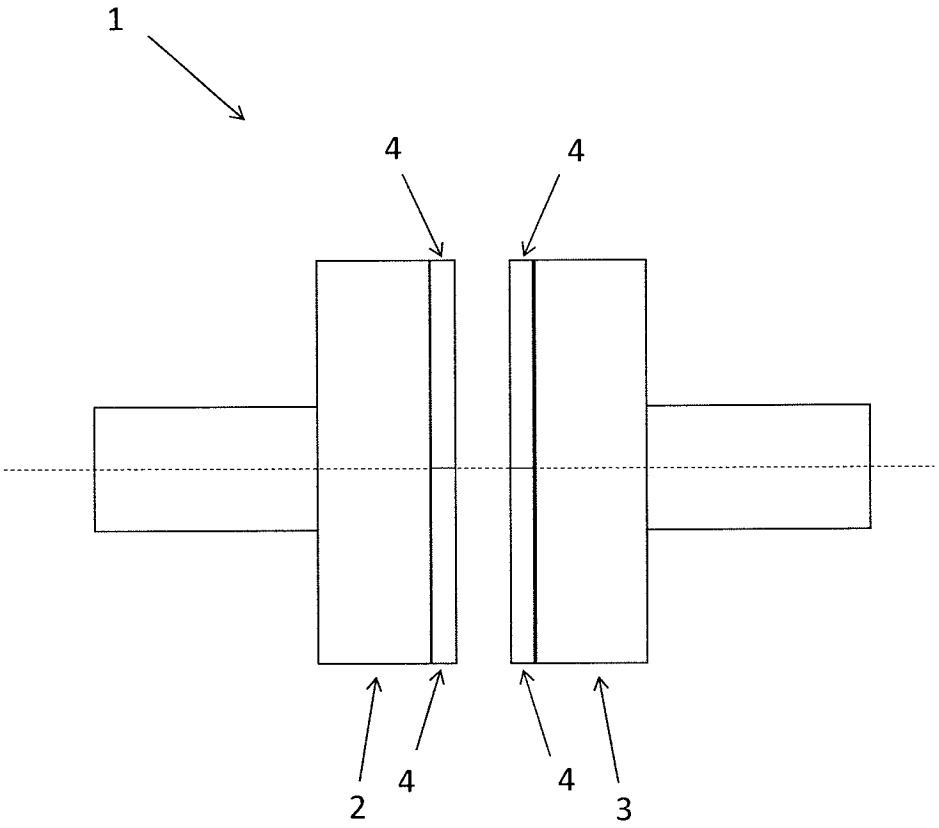
FIG. 1 is a schematic illustration of a typical refiner comprising a coaxially arranged stator/rotor disc pair according to prior art technology.

For further illustration of the prior art, a typical refiner 1 comprising refiner elements in the form of a coaxially arranged stator/rotor disc pair 2, 3 according to prior art is schematically illustrated in FIG. 1. At least one of the refiner elements/discs 2, 3 is provided with a refining surface comprising a plurality of refiner segments 4, as illustrated in FIG. 2. Each refiner segment 4 has a radially inner edge 41 facing the center of the refiner element and a radially outer/peripheral edge 42 facing the periphery of the refiner element, when the refiner segment 4 is arranged on the refiner element 2; 3. The stator/rotor disc pair 2, 3 can comprise e.g. one stator 2 and one rotor 3, or two rotors. In case of the rotor/rotor arrangement the two rotors are configured with opposing rotational directions. In the current disclosure the main emphasis is on disc refiners, but the disclosure can be equally implemented in other refiner geometries as well.

Figure 3A:
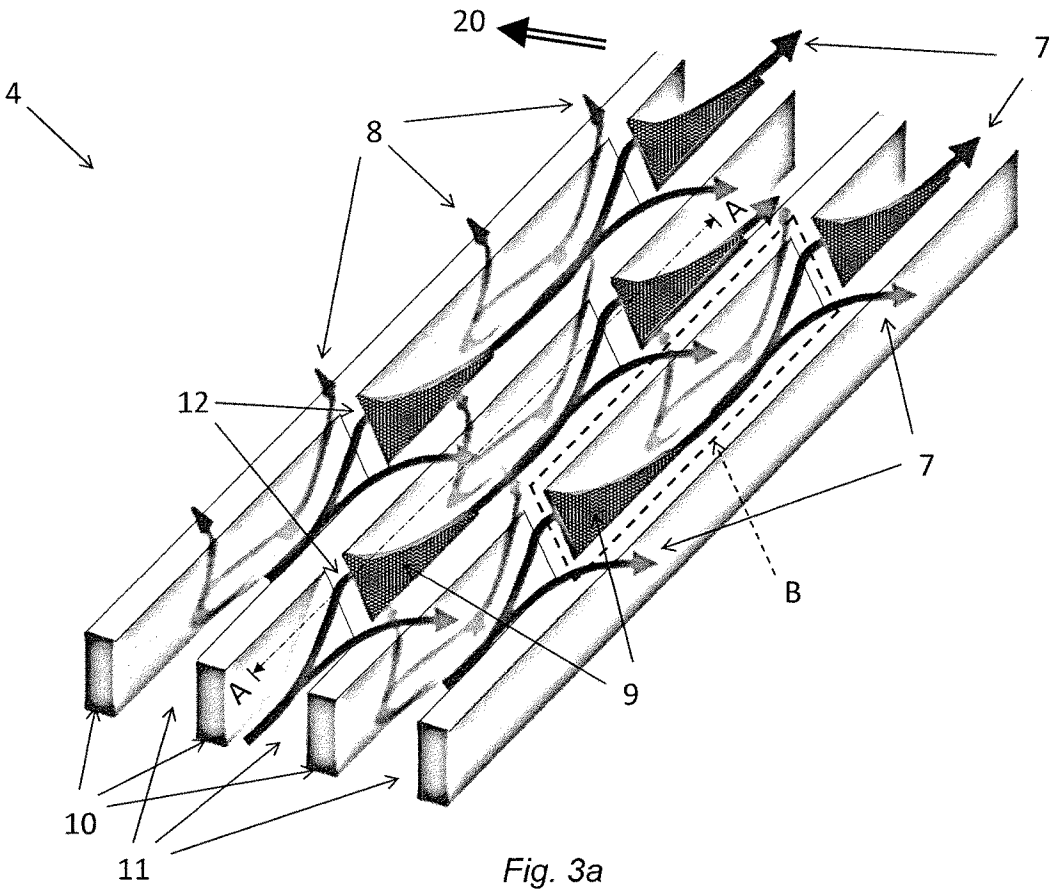
FIG. 3*a* is a schematic illustration of a part of a refiner segment according to prior art technology.

As described in the background section there is continued need in the art to further reduce the feed variations during the refining process. FIG. 3*a* is a schematic illustration of a part of a refiner segment 4 arrangeable on a refiner element according to prior art, where the refiner segment 4 is provided with bars 10 and intermediate grooves 11 extending in a substantially radial direction, and dams 12 extending between the bars 10 and protruding above the surface of the grooves 11. The figure shows the steam flow 8 and the flow of fibrous material 7 on the refiner segment 4, when the refiner segment 4 is travelling in a first circumferential direction 20 corresponding to an intended travelling direction of the refiner segment 4, which corresponds to an intended rotational direction of the refiner element when the refiner segment 4 is arranged on the refiner element. FIG. 3*a* illustrates an example where the first circumferential direction 20 of the refiner segment 4 corresponds to a counter-clockwise rotational direction of the refiner element. The material 7 flows in a direction towards the periphery of the refiner segment 4. In conventional refiner segment designs the bars 10 and dams 12 typically form closed-off "boxes" or "cages", as illustrated by the dashed box B, which traps the steam 8 and forces it upwards out of the grooves and out into the refining gap. At least the following problems are associated with this design:

- Steam 8 that is trying to go backwards (or forwards) is "caged in" and forced to find its way out into the refining gap. This causes feed conflicts between the steam 8 and the fibrous material 7 in the refining gap, which leads to feed disturbance, vibrations, micro-pulsation etc.
- The area just after the dams 12 becomes a "dead zone" with lower steam pressure and much less movement of the material 7, which causes pitch build-up 9 of the material in this zone. Once this pitch build-up starts, it will escalate.

Figure 3B:
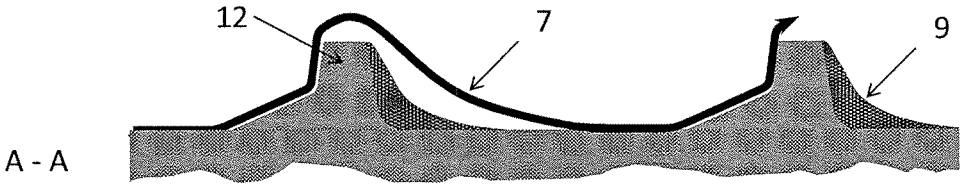
FIG. 3*b* is a cross-section of the refiner segment of FIG. 3*a*.

FIG. 3*b* is a cross-section of the refiner segment 4 along the line A-A of FIG. 3*a*, illustrating the pitch build-up 9 of the material 7 in the area behind the dam 12, from a different view.

Figure 4A:
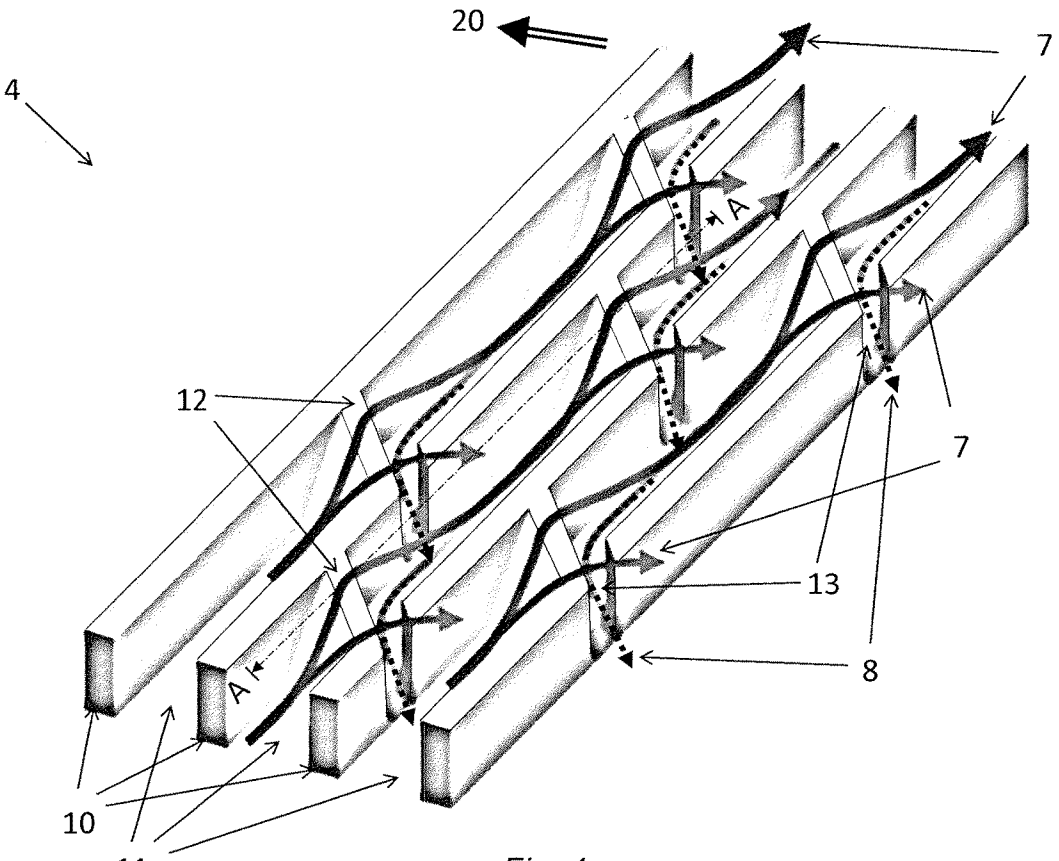
FIG. 4*a* is a schematic illustration of a part of a refiner segment according to an embodiment of the present disclosure.

The present embodiments solve the above-mentioned problems by opening up channels in the bars near the dams to release the steam from the "cages" without forcing the steam into the refining gap. FIG. 4*a* is a schematic illustration of a part of a refiner segment 4 arrangeable on a refiner element according to an embodiment of the present disclosure, where the refiner segment 4 is provided with bars 10 and intermediate grooves 11 extending in a substantially radial direction, and dams 12 extending between the bars 10 and protruding above the surface of the grooves 11. In this embodiment steam channels 13 are arranged through the bars 10 to provide a passage for the back-streaming steam 8. The figure shows the steam flow 8 and the flow of fibrous material 7 on the refiner segment 4, when the refiner segment 4 is travelling in a first circumferential direction 20 corresponding to an intended travelling direction of the refiner segment 4, which correspond to an intended rotational direction of the refiner element when the refiner segment 4 is arranged on the refiner element. FIG. 4*a* illustrates an example where the first circumferential direction 20 of the refiner segment 4 corresponds to a counter-clockwise rotational direction of the refiner element. Here the material 7 flows towards the periphery of the refiner segment 4, similarly as in FIG. 3*b*, but the back-streaming steam 8 travelling towards the inner edge of the refiner segment 4 flows along the dams 12 and passes through the channels 13 in the bars 10 in a direction having a component directed opposite to the first circumferential direction 20, into an adjacent groove 11, and then through a next channel 13, and so on towards the inner edge of the refiner segment. At least the following advantages are achieved with this design:

- Steam is released from the boxes or cages without forcing the steam to escape into the refining gap. This reduces feed conflicts in the refining gap which in turn leads to less feed disturbance, less vibrations, less micro-pulsation etc.
- The position of the channels creates steam flow and movement in the area just after the dams, which prevents this area from becoming a "dead zone" with lower steam pressure and less movement of the material, which means that pitch build-up can be avoided.

This is achieved without interfering with the flow of wood/fibrous material.

Figure 4B:
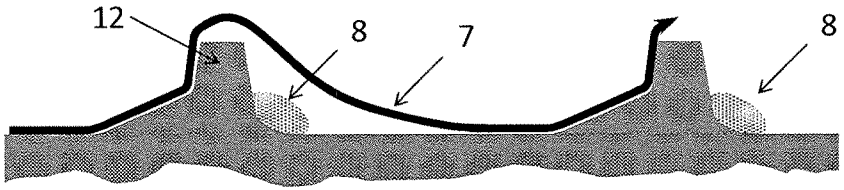
FIG. 4*b* is a cross-section of the refiner segment of FIG. 4*a*.

FIG. 4*b* is a cross-section of the refiner segment 4 along the line A-A of FIG. 4*a*, illustrating how the steam flow 8 in the area behind the dam 12 prevents pitch build-up of the material 7 in the area behind the dam 12. The pressure from the flowing steam 8 helps to "flush away" the material 7 from this zone.

In the embodiment illustrated in FIG. 4*a*, each channel 13 is arranged through a bar 10 adjacent to the intersection between a dam 12 and a bar 10, peripherally of a respective dam 12 with respect to the inner edge of the refiner segment 4, i.e. radially outside of the dam 12. The channels 13 are arranged at a trailing end of the dams 12 with respect to a first circumferential direction 20 corresponding to an intended travelling direction of the refiner segment 4, where the intended travelling direction of the refiner segment 4 corresponds to an intended rotational direction of the refiner element, in order to guide the back-streaming steam 8 through a channel 13 into an adjacent groove 11. Furthermore, the dams 12 in this embodiment are inclined such that the trailing end of a dam 12 is arranged closer to the inner edge of the refiner segment 4 than the leading end of the dam 12, so that they are "pointing" obliquely inwards on the refiner segment 4, in order to guide the back-streaming steam 8 along the peripheral edges/walls of the dams 12 towards the channels 13. The channels 13 should also be inclined so that they are pointing obliquely inwards on the refiner segment 4 in this embodiment, i.e. the trailing end of a channel 13 is arranged closer to the inner edge of the refiner segment 4 than a leading end of the channel 13.

Figure 5:
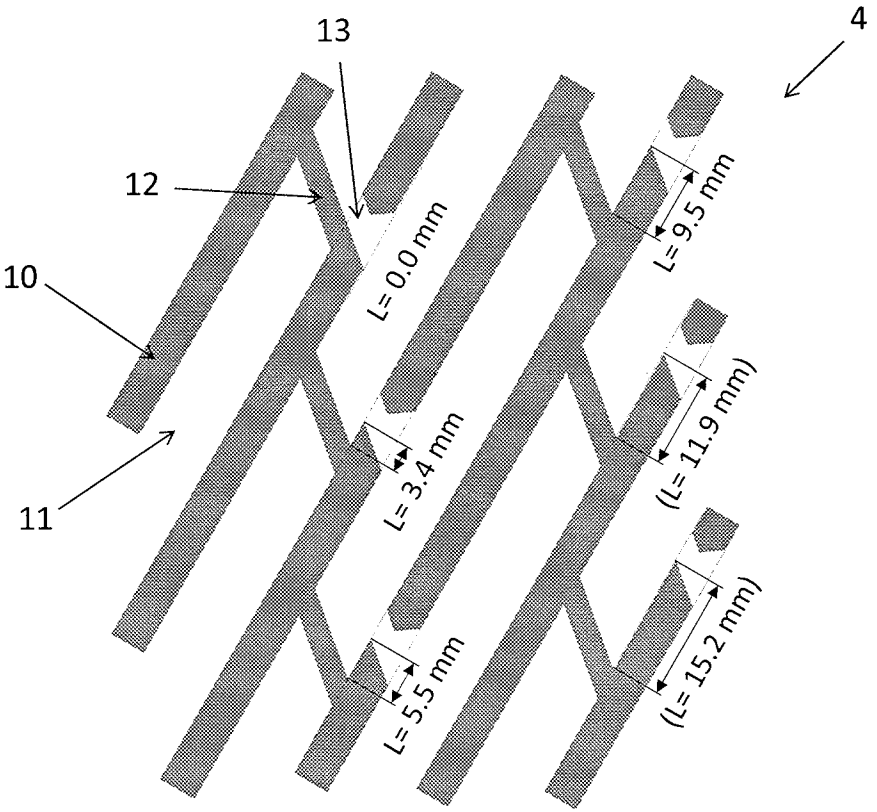
FIG. 5 is a schematic illustration of a part of a refiner segment according to an embodiment of the present disclosure.

FIG. 5 is a schematic illustration of a part of a refiner segment 4 showing different positions of the channel 13 according to an embodiment of the present disclosure. In a particular embodiment of a refiner segment for refining fibrous material according to the present disclosure the distance L between a peripheral wall/edge of a dam 12 and the inlet opening of a channel 13 does not exceed 10 mm. If the distance L is too large, the steam will have trouble finding its way through the channel and into the adjacent groove, as shown by experiment and simulation. The two channels shown at the bottom right in FIG. 5 do not fulfil this condition.

Figure 6B:
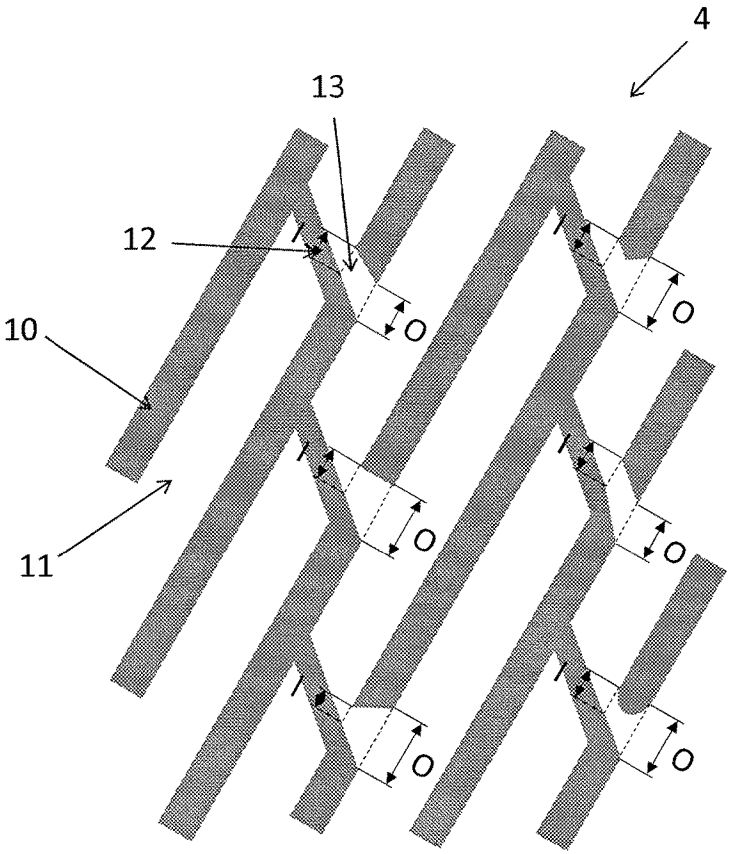
FIGS. 6*a-b* are schematic illustrations of a part of a refiner segment according to embodiments of the present disclosure.
Figure 6A:
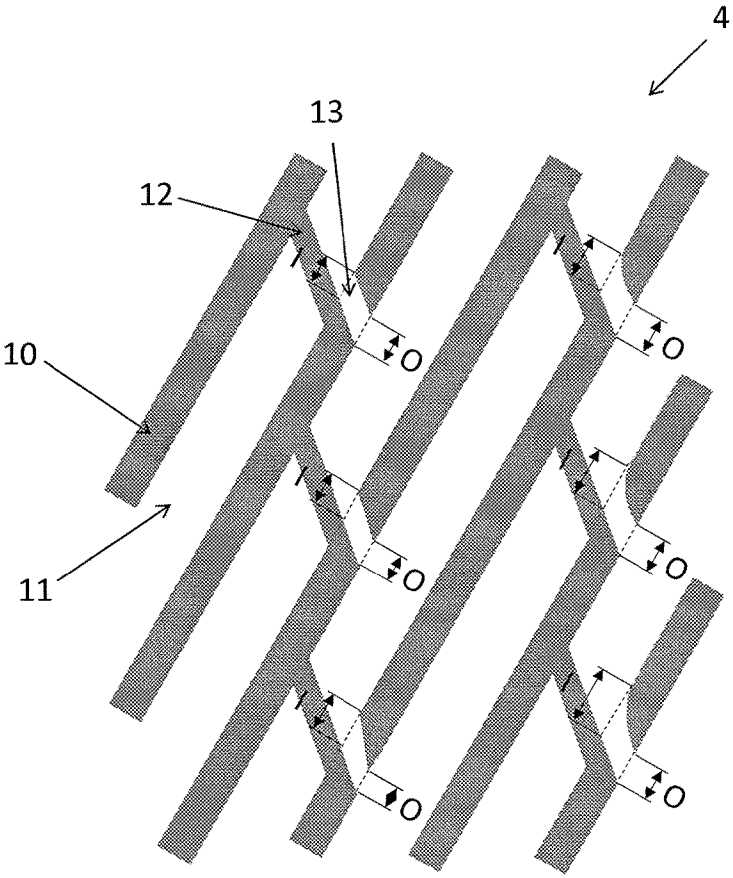

Similarly, FIGS. 6*a-b* are schematic illustrations of a part of a refiner segment showing different shapes to the channels 13 according to embodiments of the present disclosure. An outlet opening (O) for the steam is located at the trailing end of the channel (13) and an inlet opening (I) for the steam is located at the leading end of the channel (13). In a particular embodiment of a refiner segment for refining fibrous material the inlet opening I of the channel 13 is smaller than the outlet opening O, as illustrated in FIG. 6*b*. If the outlet opening O is smaller than the inlet opening I, as illustrated in FIG. 6*a*, there is a risk that the steam flow through the channel 13 will be restricted by the narrowing of the channel 13.

Figure 7B:
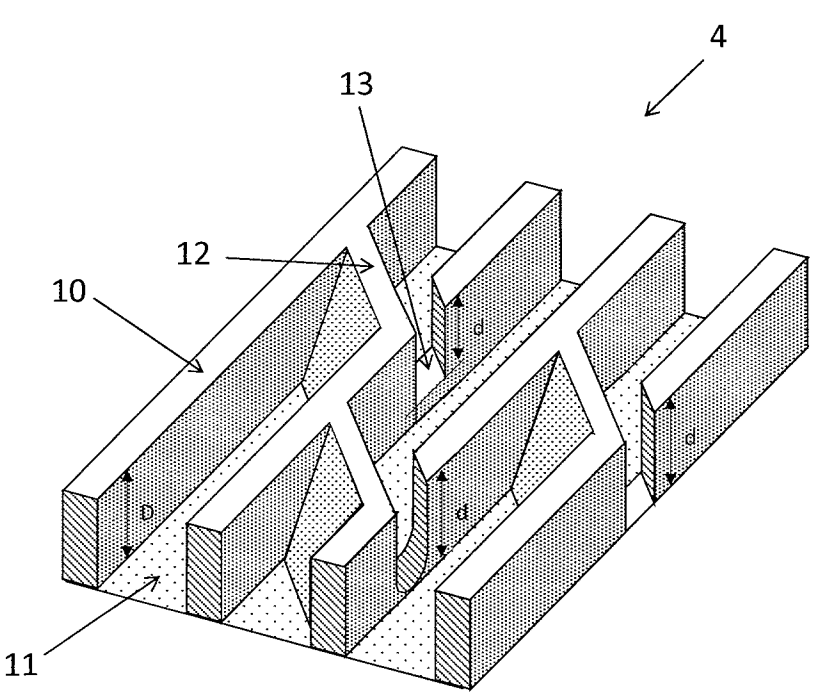
FIGS. 7*a-b* are schematic illustrations of a part of a refiner segment according to embodiments of the present disclosure.
Figure 7A:
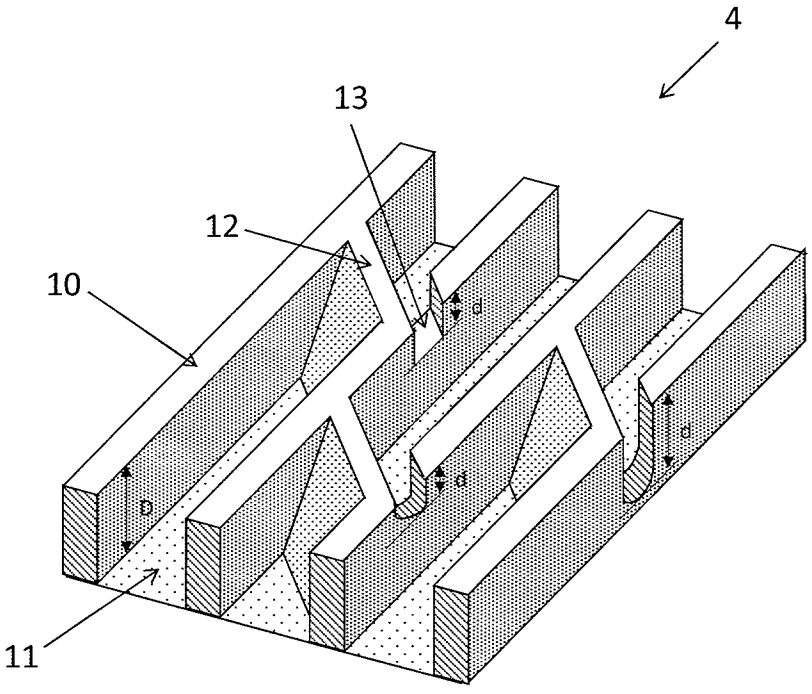

FIGS. 7*a-b* are schematic illustrations of a part of a refiner segment showing different depths of the channel 13 according to embodiments of the present disclosure. In a particular embodiment of a refiner segment for refining fibrous material the depth d of the channels 13 is larger than half the depth D of the groove, i.e. $d>D/2$, where the depths d, D are measured from a top surface of the bars 10 to a bottom surface of the channel 13 and the groove 11, respectively. The two leftmost channels shown in FIG. 7*a* do not fulfil this condition.

Figure 8:
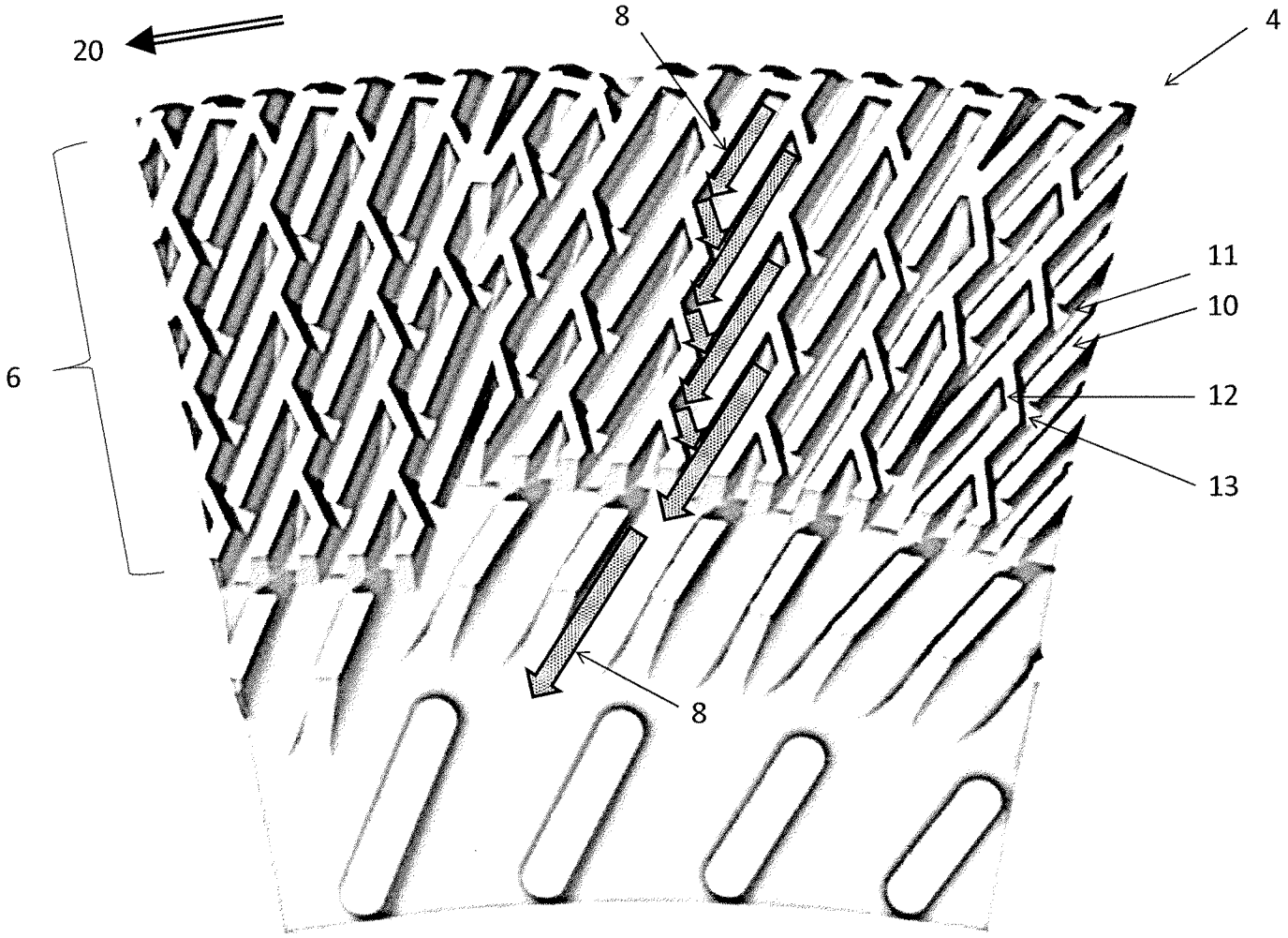
FIG. 8 is a schematic illustration of steam flow in a part of a refiner segment according to an embodiment of the present disclosure.

FIG. 8 is a schematic illustration of steam flow in a part of a refiner segment 4 comprising at least one refining zone 6 according to an embodiment of the present disclosure. As illustrated in FIG. 8, the channels 13 in this embodiment are provided over the entire surface of the refining zone 6 of the refiner segment 4, thereby creating/forming a free passage through the entire refining zone 6 for the steam 8 flowing through the channels and grooves towards the inner edge of the refiner segment and the center of the refiner element/disc. This will allow steam to be evacuated from the refining zone 6 with minimum conflict with the flow of wood/fibrous material. In a particular embodiment, channels 13 are provided adjacent to all the dams 12 on the refiner segment 4.

All embodiments of the present disclosure can be fitted to a refiner arrangement well known in the art, for example refiners with a rotor-stator arrangement as well as refiners with two rotors instead of a rotor-stator arrangement, i.e. two rotors that can be rotated independently. In the current disclosure the main emphasis is on disc refiners, but the disclosure can be equally implemented in other refiner geometries as well.

The embodiments described above are merely given as examples, and it should be understood that the proposed technology is not limited thereto. It will be understood by those skilled in the art that various modifications, combinations and changes may be made to the embodiments without departing from the present scope as defined by the appended claims. In particular, different part solutions in the different embodiments can be combined in other configurations, where technically possible.

The invention claimed is:

1. A refiner segment for a disc refiner for refining fibrous material configured to form a part of a refining surface of a disc refiner element and travel in a first circumferential direction when arranged on the refiner element, the refiner segment comprising:

a refining surface;

a radially inner edge;

a radially outer edge;

a pattern of bars and intermediate grooves configured to extend along the refiner segment in a substantially radial direction with respect to the radially inner edge;

dams configured to extend between the bars and protrude above a surface of the intermediate grooves; and a plurality of steam channels formed through the bars and configured to allow steam flowing towards the radially inner edge to pass through the plurality of steam channels in a direction having a component directed opposite to the first circumferential direction, wherein each steam channel of the plurality of steam channels is disposed adjacent to an intersection between a bar and a dam, radially outside of a respective dam with respect to the radially inner edge, and at a trailing end of the respective dam with respect to the first circumferential direction, wherein each steam channel of the plurality of steam channels includes:

an inlet opening located at a leading end of the steam channel, and an outlet opening located at a trailing end of the steam channel with respect to the first circumferential direction of the refiner segment, wherein a distance between each inlet opening of a channel and a peripheral wall of the respective dam, with respect to the radially inner edge of the refiner segment, is zero.

2. The refiner segment according to claim 1, wherein the dams are inclined such that the trailing end of each dam is arranged closer to the inner edge of the refiner segment than a leading end of each dam.

3. The refiner segment according to claim 1, wherein the plurality of steam channels are inclined such that the outlet opening of each steam channel of the plurality of steam channels is arranged closer to the inner edge of the refiner segment than an inlet opening of a channel.

4. The refiner segment according to claim 1, wherein the inlet opening of each steam channel of the plurality of steam channels is smaller than the outlet opening of each steam channel.

5. The refiner segment according to claim 1, wherein depth of the plurality of steam channels is measured from a top surface of the bars to a bottom surface of the steam channels;

depth of the intermediate grooves is measured from a top surface of the bars to a bottom surface of the intermediate grooves; and the depth of the plurality of steam channels is larger than the depth of the intermediate grooves divided by two.

6. The refiner segment according to claim 1, further comprising at least one refining zone where refining of the fibrous material takes place, wherein the plurality of steam channels are provided throughout the refining zone to form a free passage for steam flowing towards the inner edge of the refiner segment.

7. A disc refiner for refining fibrous material comprising at least one refiner segment according to claim 1.

* * * * *